US010121487B2

(12) United States Patent
Baijal et al.

(10) Patent No.: US 10,121,487 B2
(45) Date of Patent: Nov. 6, 2018

(54) SIGNALING PROCESSOR CAPABLE OF GENERATING AND SYNTHESIZING HIGH FREQUENCY RECOVER SIGNAL

(71) Applicant: SAMSUNG ELECTRONICS CO., LTD., Suwon-si, Gyeonggi-do (KR)

(72) Inventors: Anant Baijal, Suwon-si (KR); Hyeon Sik Jeong, Yongin-si (KR); Byeong Seob Ko, Suwon-si (KR); Hyunjoo Chung, Suwon-si (KR); Sang Mo Son, Suwon-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/813,607

(22) Filed: Nov. 15, 2017

(65) Prior Publication Data

US 2018/0144758 A1 May 24, 2018

(30) Foreign Application Priority Data

Nov. 18, 2016 (KR) ..... 10-2016-0153731

(51) Int. Cl.

| | |
|---|---|
| ***G10L 19/26*** | (2013.01) |
| ***G10L 19/02*** | (2013.01) |
| ***G10L 19/022*** | (2013.01) |
| ***G10L 19/08*** | (2013.01) |
| ***G10L 19/24*** | (2013.01) |
| ***G10L 21/0388*** | (2013.01) |

(52) U.S. Cl.

CPC ..... *G10L 19/265* (2013.01); *G10L 19/022* (2013.01); *G10L 19/0208* (2013.01); *G10L 19/08* (2013.01); *G10L 19/24* (2013.01); *G10L 21/0388* (2013.01)

(58) Field of Classification Search

None

See application file for complete search history.

(56) References Cited

U.S. PATENT DOCUMENTS

| | | | | |
|---|---|---|---|---|
| 2002/0188365 | A1 | 12/2002 | Kuwaoda | |
| 2003/0044024 | A1 | 3/2003 | Aarts et al. | |
| 2003/0093279 | A1 | 5/2003 | Malah et al. | |
| 2005/0195981 | A1* | 9/2005 | Faller | G10L 19/008 381/23 |
| 2007/0129036 | A1 | 6/2007 | Arora | |

(Continued)

FOREIGN PATENT DOCUMENTS

| | | |
|---|---|---|
| EP | 1 892 703 | 2/2008 |

*Primary Examiner* — Tan X Dinh

(74) *Attorney, Agent, or Firm* — Nixon & Vanderhye, P.C.

(57) ABSTRACT

A signaling processor is provided. The signaling processor includes a frequency domain processing module configured to generate a cut-off frequency of an input signal and to generate level information for adjusting a level of a high frequency recovery signal and a time domain processing module configured to receive the cut-off frequency and the level information from the frequency domain processing module, to generate a signal having a frequency greater than or equal to the cut-off frequency using part of a signal of a frequency lower than the cut-off frequency in the input signal, to generate the high frequency recovery signal by adjusting a level of the generated signal using the level information, and to synthesize the high frequency recovery signal with the input signal.

20 Claims, 13 Drawing Sheets

(56) References Cited

U.S. PATENT DOCUMENTS

| | | | | |
|---|---|---|---|---|
| 2007/0282599 | A1 | 12/2007 | Choo et al. | |
| 2008/0059155 | A1 | 3/2008 | Iser et al. | |
| 2010/0198587 | A1 | 8/2010 | Ramabadran et al. | |
| 2010/0228543 | A1 | 9/2010 | Kabal et al. | |
| 2010/0266141 | A1* | 10/2010 | Vernon | H04R 3/04 381/94.1 |
| 2010/0292994 | A1 | 11/2010 | Lee et al. | |
| 2011/0282655 | A1 | 11/2011 | Endo | |
| 2012/0002824 | A1* | 1/2012 | Basaran | G10L 21/038 381/98 |
| 2012/0243526 | A1 | 9/2012 | Yamamoto et al. | |
| 2012/0328121 | A1 | 12/2012 | Truman et al. | |
| 2013/0144614 | A1 | 6/2013 | Myllyla et al. | |
| 2017/0337926 | A1* | 11/2017 | Chon | G10L 19/02 381/98 |

* cited by examiner

SIGNALING PROCESSOR CAPABLE OF GENERATING AND SYNTHESIZING HIGH FREQUENCY RECOVER SIGNAL

CROSS-REFERENCE TO RELATED APPLICATION

This application is based on and claims priority under 35 U.S.C. § 119 to a Korean patent application filed on Nov. 18, 2016 in the Korean Intellectual Property Office and assigned Serial number 10-2016-0153731, the disclosure of which is incorporated by reference herein in its entirety.

TECHNICAL FIELD

The present disclosure relates generally to a signaling processor for recovering a signal of a high frequency band and a control method thereof.

BACKGROUND

To efficiently compress and transmit an audio signal, part of a frequency band of the audio signal may be removed. A format for compressing audio data may be a moving picture experts group (MPEG)-1 audio layer 3 (MP3), advanced audio coding (ACC), window media audio (WMA), or the like. An audio codec may include a specified frequency for removing part of a frequency band of an audio signal when compressing the audio signal.

If part of a frequency band of an audio signal is lost, the audio signal may deteriorate in sound quality and may be changed in timbre. Thus, when an audio signal, a partial frequency band of which is lost, is played back, the lost frequency band of the audio signal may be recovered to enhance sound quality and timbre.

If compression information is included in an audio signal, a lost frequency band of the audio signal may be recovered according to a criterion of the compression information. If the compression information is not included in the audio signal, the lost frequency band may be recovered by analyzing a spectrum of the audio signal.

SUMMARY

A specified frequency band in a compressed audio signal may be lost, and the lost frequency band may be a high frequency band in an audible frequency. Although the high frequency band in the audible frequency is lost, there is no problem with listening to an audio signal. However, as the high frequency band is lost, the audio signal may vary in sound quality and timbre.

If there is no additional information for recovering a lost frequency band, a spectrum may be analyzed to recover a lost frequency. It is possible to recover an accurate frequency in a frequency domain, whereas a process of adjusting a phase is needed and is very complicated in the frequency domain. Complexity is low in a time domain, and a difference between a natural audio and a compressed audio may fail to be distinguished in the time domain.

Example aspects of the present disclosure address at least the above-mentioned problems and/or disadvantages and provide at least the advantages described below. Accordingly, an example aspect of the present disclosure provides a signaling processor for analyzing a characteristic of an audio signal in a frequency domain when recovering a lost frequency band and generating an accurate recovery signal using the analyzed information in a time domain and a control method thereof.

In accordance with an example aspect of the present disclosure, a signaling processor is provided. The signaling processor may include a frequency domain processing module comprising processing circuitry configured to generate a cut-off frequency of an input signal and to generate level information for adjusting a level of a high frequency recovery signal and a time domain processing module comprising processing circuitry configured to receive the cut-off frequency and to receive the level information from the frequency domain processing module, the signaling processor configured to generate a signal having a frequency greater than or equal to the cut-off frequency using part of a signal of a frequency lower than the cut-off frequency in the input signal, to generate the high frequency recovery signal by adjusting a level of the generated signal using the level information, and to synthesize the high frequency recovery signal with the input signal.

In accordance with another example aspect of the present disclosure, a control method of a signaling processor is provided. The method may include generating a cut-off frequency of an input signal and level information for adjusting a level of a high frequency recovery signal in a frequency domain, generating a signal having a frequency greater than or equal to the cut-off frequency using part of a signal of a frequency lower than the cut-off frequency in the input signal in a time domain, generating the high frequency recovery signal by adjusting a level of the generated signal using the level information in the time domain, and synthesizing the high frequency recovery signal with the input signal in the time domain.

A signaling processor according to an example embodiment of the present disclosure may reduce complexity which may occur when performed in only one domain and may quickly recover an input signal by generating a cut-off frequency and frequency band information for recovering a frequency band higher than the cut-off frequency at a frequency domain processing module if recovering the frequency band higher than the cut-off frequency of the input signal and recovering the frequency band higher than the cut-off frequency of the input signal at a time domain processing module using the generated cut-off frequency and the generated frequency band information.

The time domain processing module may separately generate even harmonics and odd harmonics of an input signal and may amplify the even harmonics and the odd harmonics depending on a characteristic of the input signal. Further, the time domain processing module may recover an input signal to be similar to audio data before compression without a distortion and/or with reduced distortion of a signal by setting a gain value of a spectrum shaper based on frequency band information and processing harmonics generated by the spectrum shaper.

In addition, a variety of effects directly or indirectly ascertained through the present disclosure may be provided.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and attendant advantages of the present disclosure will be more apparent and readily appreciated from the following detailed description, taken in conjunction with the accompanying drawings, in which like reference numerals refer to like elements, and wherein.

Throughout the drawings, it should be noted that like reference numbers are used to depict the same or similar elements, features, and structures.

DETAILED DESCRIPTION

Hereinafter, a description will be provided in greater detail of various example embodiments of the present disclosure with reference to the accompanying drawings.

Example embodiments of the present disclosure may be provided to more fully describe the present disclosure to those skilled in the art. The various example embodiments below may be modified in several different forms. The scope of the present disclosure is not limited to example embodiments below. Rather, these example embodiments are illustrative examples provided to illustrate the spirit of the present disclosure to those skilled in the art.

Terms used in this disclosure are used to describe specified embodiments and are not intended to limit the scope of another embodiment. The terms of a singular form may include plural forms unless otherwise specified. All the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal unless expressly so defined in various embodiments of this disclosure. In some cases, even if terms are terms which are defined in this disclosure, they may not be interpreted to exclude embodiments of this disclosure.

Figure 1:
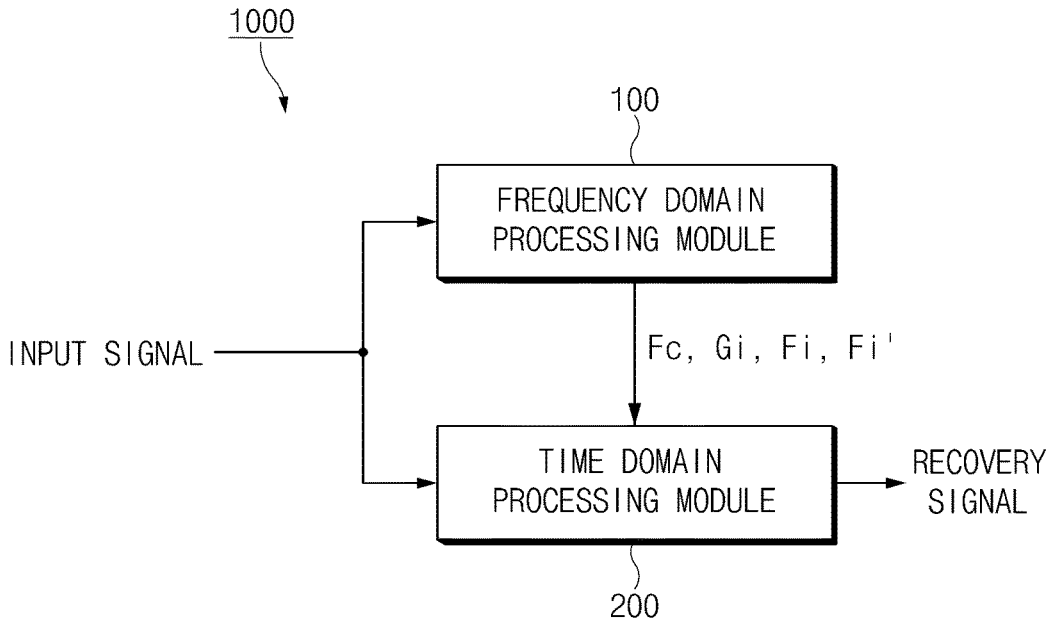
FIG. 1 is a block diagram illustrating an example configuration of a signaling device according to various example embodiments of the present disclosure.

FIG. 1 is a block diagram illustrating an example configuration of a signaling device according to various example embodiments of the present disclosure.

Referring to FIG. 1, a signaling device 1000 may include a frequency domain processing module (e.g., including processing circuitry and/or program elements) 100 and a time domain processing module (e.g., including processing circuitry and/or program elements) 200. The signaling device 1000 may recover and output a high frequency band of an input signal. For example, a signal input to the signaling device 1000 may be an audio signal.

According to an embodiment, the signaling device 1000 may be implemented with a processor (e.g., including processing circuitry). For example, the signaling device 1000 may include at least one processor which may perform at least one function. According to an embodiment, the signaling device 1000 may be implemented with a system on chip (SoC) including, for example, and without limitation, a central processing unit (CPU), a memory, and the like.

The frequency domain processing module 100 may change an input signal into a frequency domain and may determine (or generate) a cut-off frequency. The cut-off frequency may be a boundary frequency of dividing a frequency band which is passed or cut off. The input signal may be a signal in which a signal of a cut-off frequency or more (or a signal having a frequency greater than or equal to the cut-off frequency) is blocked. The frequency domain processing module 100 may analyze the input signal and may determine a cut-off frequency.

According to an embodiment, the frequency domain processing module 100 may generate (or determine) level information for adjusting a level of the input signal. For example, the frequency domain processing module 100 may analyze the input signal and may generate level information for adjusting a level of the input signal at the time domain processing module 200.

The time domain processing module 200 may process the input signal to recover a signal of the cut-off frequency or more of the input signal. According to an embodiment, the time domain processing module 200 may receive the cut-off frequency from the frequency domain processing module 100 and may generate a signal of the cut-off frequency or more using the received cut-off frequency. According to an embodiment, the time domain processing module 200 may receive level information for adjusting a level of the input signal from the frequency domain processing module 100 and may process the generated signal of the cut-off frequency or more based on the level information. The time domain processing module 200 may generate a high frequency recovery signal using the processed signal of the cut-off frequency or more. The time domain processing module 200 may generate a recovery signal of the input signal by synthesizing the high frequency recovery signal with the input signal.

Figure 2:
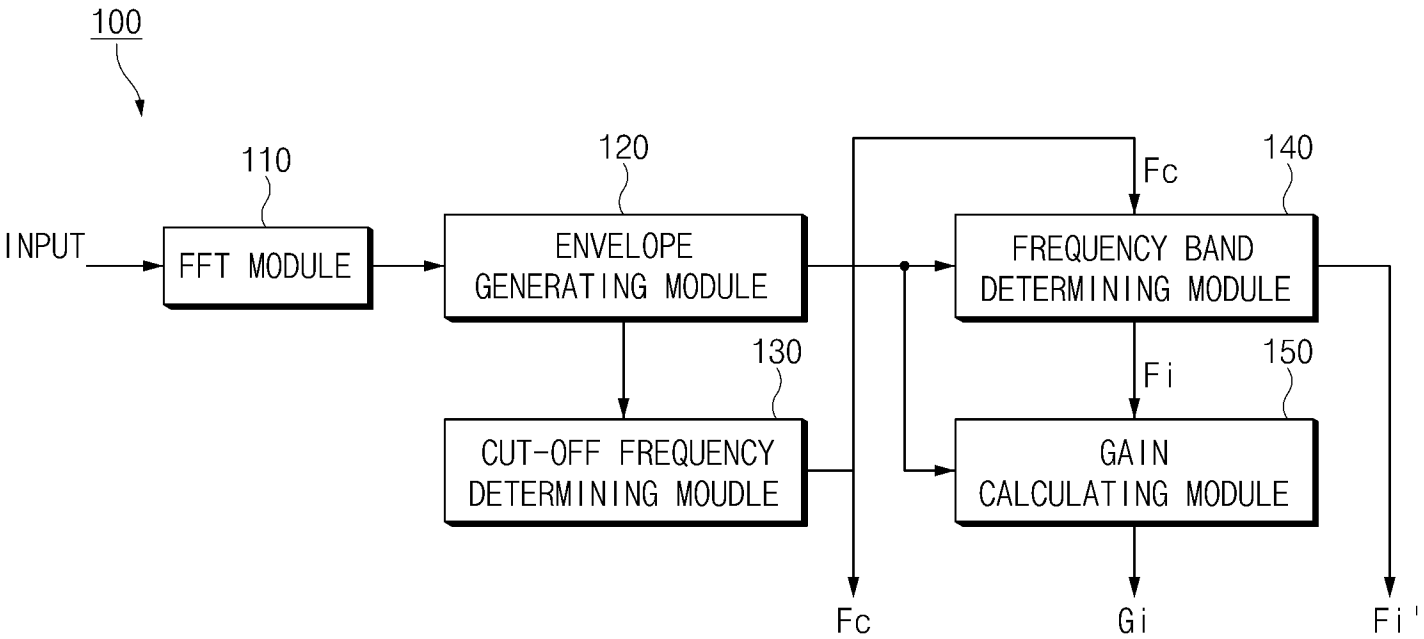
FIG. 2 is a block diagram illustrating an example configuration of a frequency domain processing module according to various example embodiments of the present disclosure.

FIG. 2 is a block diagram illustrating an example configuration of a frequency domain processing module according to various example embodiments of the present disclosure.

Referring to FIG. 2, a frequency domain processing module 100 may include a fast Fourier transform (FFT) module (e.g., including processing circuitry and/or program elements) 110, an envelope generating module (e.g., including processing circuitry and/or program elements) 120, a cut-off frequency determining module (e.g., including processing circuitry and/or program elements) 130, a frequency band determining module (e.g., including processing circuitry and/or program elements) 140, and a gain calculating module (e.g., including processing circuitry and/or program elements) 150.

The FFT module 110 may change an input signal to a frequency domain. The FFT module 110 may perform Fourier transform of the input to change the input signal to the frequency domain.

The envelope generating module 120 may generate an envelope of the input signal changed to the frequency domain. For example, the envelope generating module 120 may change a level of the input signal changed to the frequency domain to a decibel (dB) value and may generate an envelope of the signal with the changed dB value.

The cut-off frequency determining module 130 may receive the input signal, in which the envelope is generated, from the envelope generating module 120. The input signal may be an audio signal, a high frequency region, higher than a cut-off frequency Fc, of which is lost. For example, the audio signal may be lost in a high frequency band in an audible frequency band to compress audio data. The audio signal may change in timbre and may deteriorate in sound quality as audio data of a high frequency band is lost. A format for compressing the audio data may be, for example, a moving picture experts group (MPEG)-1 audio layer 3 (MP3), advanced audio coding (ACC), Ogg, or the like. The format may include a specified cut-off frequency. If a bit rate is 96 kbps, a cut-off frequency of the MP3 may be 15.5 kHz, a cut-off frequency of the ACC may be 16 kHz, and a cut-off frequency of the Ogg may be 19.2 kHz.

According to an embodiment, the cut-off frequency determining module 130 may determine the cut-off frequency Fc using additional information included in the input signal. The additional information may include, for example, and without limitation, information about a compression format (e.g., bit rate information of an input signal or codec information). The cut-off frequency determining module 130 may determine the cut-off frequency Fc using the information about the compression format. According to another embodiment, the cut-off frequency determining module 130 may determine the cut-off frequency Fc without additional information including information about the cut-off frequency Fc.

Figure 3A:
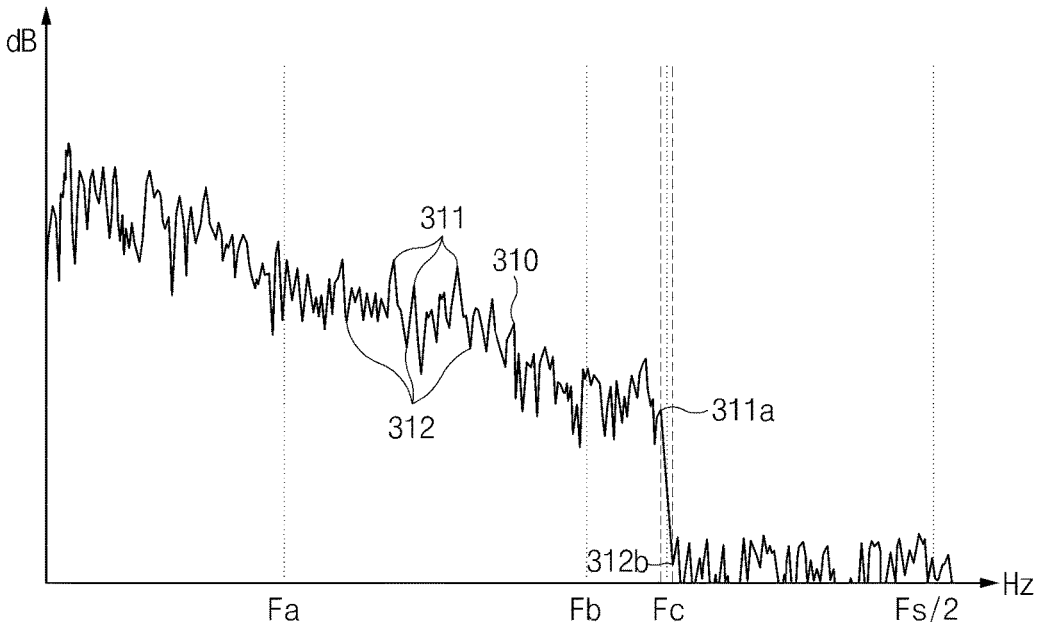
FIG. 3A is a graph illustrating predicting a cut-off frequency of a cut-off frequency predicting module according to an example embodiment of the present disclosure.

FIG. 3A is a graph illustrating predicting a cut-off frequency of a cut-off frequency predicting module according to an example embodiment of the present disclosure.

Referring to FIG. 3A, an input signal 310 may include a plurality of peaks 311 and a plurality of valleys 312. For example, an envelope of the input signal 310 may be generated by an envelope generating module 120 of FIG. 2. The envelope of the input signal 310 may include the plurality of peaks 311 and the plurality of valleys 312.

According to an embodiment, the cut-off frequency determining module 130 of FIG. 2 may determine a cut-off frequency Fc through the plurality of peaks 311 and the plurality of valleys 312 of the input signal 310. The cut-off frequency determining module 130 may verify a level difference between one of the plurality peaks 311 and one of the plurality of valleys 312 (e.g., a difference between one peak and one valley adjacent to the one peak) and may determine a frequency, included in a frequency band with the highest level difference between a peak 311*a* and a valley 312*b*, as the cut-off frequency Fc. For example, the cut-off frequency determining module 130 may determine a middle frequency of a frequency band, which has a frequency of the peak 311*a* and the 312*b* with the highest level difference as a boundary, as the cut-off frequency Fc. For another example, the cut-off frequency determining module 130 may determine the frequency of the peak 311*a* and the valley 312*b* with the highest level difference as the cut-off frequency Fc.

According to an embodiment, the cut-off frequency determining module 130 may determine the cut-off frequency Fc in any frequency band. The cut-off frequency determining module 130 may verify a level difference between each of the plurality of peaks 311 and each of the plurality of valleys 312 in the any frequency band and may determine the cut-off frequency Fc.

For example, if the input signal 310 does not include additional information about a format of the input signal 310, the cut-off frequency determining module 130 may determine the cut-off frequency Fc in a frequency band between a first frequency Fa and a frequency Fs/2 corresponding to ½ of a sampling frequency Fs. In other words, the any frequency band may be a frequency band between the first frequency Fa and the frequency Fs/2 corresponding to ½ of the sampling frequency Fs. The first frequency Fa may be, for example, a sufficiently lower frequency than the cut-off frequency Fc. The first frequency Fa may be a frequency (e.g., 6 kHz) corresponding to ½ of a specified cut-off frequency in an audio format such as MP3, ACC, or Ogg. The frequency Fs/2 corresponding to ½ of the sampling frequency Fs may be a range in which the input signal 310 may be recovered, and the sampling frequency Fs may be greater than or equal to two times of a maximum frequency of the input signal 310.

For another example, if the input signal 310 includes the additional information about the format of the input signal 310, the cut-off frequency determining module 130 may determine the cut-off frequency Fc using the additional information. The cut-off frequency determining module 130 may determine the cut-off frequency Fc in a frequency band between a second frequency Fb and the frequency Fs/2 corresponding to ½ of the sampling frequency Fs. In other words, the any frequency may be a frequency band between the second frequency Fb and the frequency Fs/2 corresponding to ½ of the sampling frequency Fs. The second frequency Fb may be determined using, for example, the additional information (e.g., bit rate information or codec information). In other words, the cut-off frequency determining module 130 may ascertain the cut-off frequency on specifications of the input signal 310 using the additional information and may determine a frequency lower than the cut-off frequency on the specifications as the second frequency Fb. Thus, the cut-off frequency determining module 130 may determine the real cut-off frequency Fc of the input signal 310 in a narrower frequency band than if the input signal 310 does not include the additional information (e.g., a frequency band between the second frequency Fb and the frequency Fs/2 corresponding to ½ of the sampling frequency Fs).

The frequency band determining module 140 of FIG. 2 may receive a signal changed in the form of an envelope from the envelope generating module 120. The frequency band determining module 140 may divide each of a frequency band lower than the cut-off frequency Fc of the input signal 310 and a frequency band higher than the cut-off frequency Fc into a plurality of frequency bands. The frequency band determining module 140 may divide each of the frequency bands such that the plurality of divided frequency bands correspond to each other. Thus, the frequency band determining module 140 may generate a first reference frequency Fi for dividing a frequency band lower than the cut-off frequency Fc and a second reference frequency Fi' for dividing a frequency band higher than the cut-off frequency Fc. According to an embodiment, the frequency band determining module 140 may transmit the first reference frequency Fi and the second reference frequency Fi' to a gain calculating module 150 of FIG. 2 and a time domain processing module 200 of FIG. 1, respectively.

The gain calculating module 150 may receive an input signal, an envelope of which is generated, from the envelope generating module 120 and may receive the first reference frequency Fi from the frequency band determining module 140. For example, the gain calculating module 150 may divide a frequency band lower than the cut-off frequency Fc of the received input signal, into a plurality of frequency bands using the first reference frequency Fi. The gain calculating module 150 may generate information about the plurality of frequency bands. Thus, the gain calculating module 150 may transmit the generated information to the time domain processing module 200.

Figure 3B:
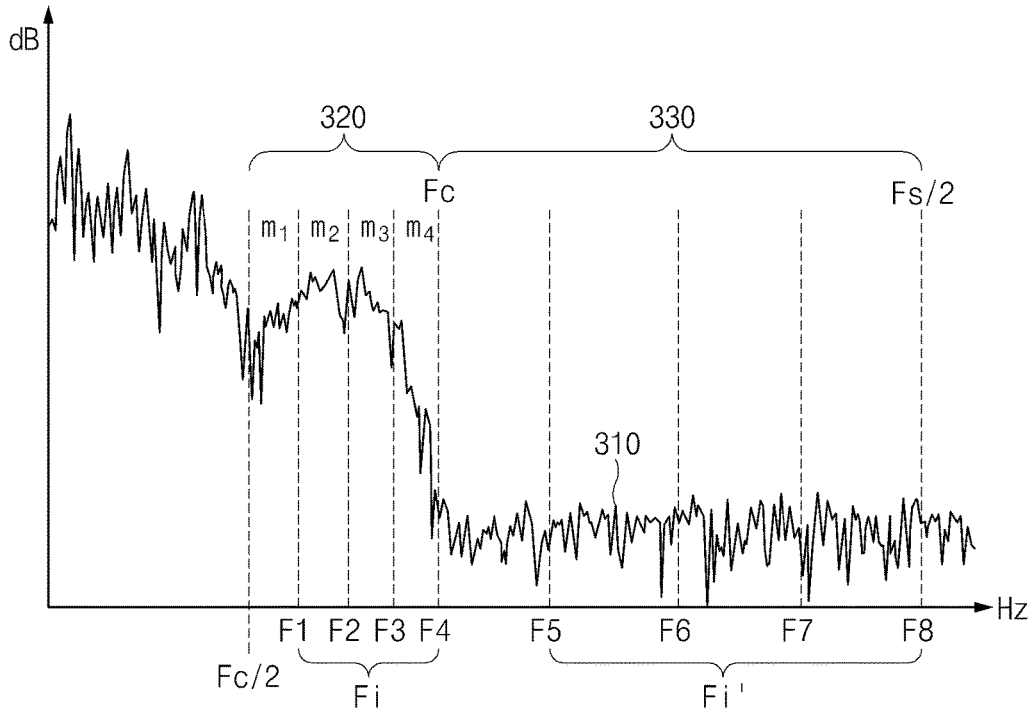
FIG. 3B is a graph illustrating calculating a gain difference according to an example embodiment of the present disclosure.

FIG. 3B is a graph illustrating calculating a gain difference according to an example embodiment of the present disclosure.

Referring to FIG. 3B, a frequency band determining module 140 of FIG. 2 may divide a frequency band lower than a cut-off frequency Fc of an input signal into a first plurality of frequency bands 320 and may divide a frequency band higher than the cut-off frequency Fc of the input signal into a second plurality of frequency bands 330.

According to an embodiment, the frequency band determining module 140 may divide a frequency band between a frequency Fc/2 corresponding to ½ of the cut-off frequency Fc and the cut-off frequency Fc into the first plurality of frequency bands 320. For example, the frequency band determining module 140 may divide the frequency band between the frequency Fc/2 corresponding to ½ of the cut-off frequency Fc and the cut-off frequency Fc (e.g., divide the frequency band into four frequency bands) with respect to a first frequency F1, a second frequency F2, a third frequency F3, and a fourth frequency F4. The fourth frequency F4 may be the same as, for example, the cut-off frequency Fc. However, an embodiment is not limited thereto. For another example, the frequency band determining module 140 may divide the frequency band between the frequency Fc/2 corresponding to ½ of the cut-off frequency Fc and the cut-off frequency Fc into n frequency bands.

According to an embodiment, the frequency band determining module 140 may divide a frequency between the cut-off frequency Fc and a frequency Fs/2 corresponding to ½ of a sampling frequency Fs into the second plurality of frequency bands 330. For example, the frequency band determining module 140 may divide the frequency band between the cut-off frequency Fc and the frequency Fs/2 corresponding to ½ of the sampling frequency Fs (e.g., divide the frequency band into four frequency bands) with respect to a fifth frequency F5, a sixth frequency F6, a seventh frequency F7, and an eighth frequency F8. The eighth frequency F8 may be, for example, the frequency Fs/2 corresponding to ½ of the sampling frequency Fs. However, an embodiment is not limited thereto. For another example, the frequency band determining module 140 may divide the frequency band between the cut-off frequency Fc and the frequency Fs/2 corresponding to ½ of the sampling frequency Fs into n frequency bands.

According to an embodiment, the frequency band determining module 140 may divide the frequency band higher than the cut-off frequency Fc into the second plurality of frequency bands 330 so as to correspond to the first plurality of frequency bands 320, respectively. For example, the second plurality of frequency bands 330 may be divided into the same number as the first plurality of frequency bands 320. The first frequency F1, the second frequency F2, the third frequency F3, the fourth frequency F4 may correspond to, for example, the fifth frequency F5, the sixth frequency F6, the seventh frequency F7, and the eighth frequency F8, respectively. A ratio between frequency bands of the first plurality of frequency bands 320 may be similar to a ratio between frequency bands of the second plurality of frequency bands 330.

Thus, the frequency band determining module 140 may determine the first frequency F1, the second frequency F2, the third frequency F3, and the fourth frequency F4 as a first reference frequency Fi of the first plurality of frequency bands 320 and may determine the fifth frequency F5, the sixth frequency F6, the seventh frequency F7, and the eighth frequency F8 as a second reference frequency Fi' of the second plurality of frequency bands 330.

The gain calculating module 150 may generate information for adjusting a level of harmonics based on information about the first plurality of divided frequency bands 320.

According to an embodiment, the gain calculating module 150 may divide the frequency band between the frequency Fc/2 corresponding to ½ of the cut-off frequency Fc of the input signal and the cut-off frequency Fc with respect to the first frequency F1, the second frequency F2, the third frequency F3, and the fourth frequency F4. According to an embodiment, the gain calculating module 150 may calculate an average level value of a signal in each of the first plurality of frequency bands 320. For example, the gain calculating module 150 may calculate a first average level value m1 from the frequency Fc/2 corresponding to ½ of the cut-off frequency Fc to the first frequency F1, a second average level value m2 from the first frequency F1 to the second frequency F2, a third average level value m3 from the second frequency F2 to the third frequency F3, and a fourth average level value m4 from the third frequency F3 to the fourth frequency F4.

According to an embodiment, the gain calculating module 150 may calculate a gain value as a difference between an average level value of each of the first plurality of frequency bands 320 and an average level value of a frequency band adjacent to each of the first plurality of frequency bands 320. For example, the gain calculating module 150 may calculate a gain value as a difference between adjacent average level values relative to the first reference frequency Fi. The gain calculating module 150 may calculate a gain value G2 as a difference (e.g., m2−m1) between the first average level value m1 and the second average level value m2 relative to the first frequency F1. The gain calculating module 150 may calculate a gain value G3 as a difference (e.g., m3−m2) between the second average level value m2 and the third average level value m3 relative to the first frequency F2. The gain calculating module 150 may calculate a gain value G4 as a difference (e.g., m4−m3) between the third average level value m3 and the fourth average level value m4 relative to the third frequency F3. The gain calculating module 150 may calculate a gain value G1 as a difference (e.g., m1−m4) between the fourth average level value m4 and the first average level value m1 relative to the fourth frequency F4.

According to the above-mentioned embodiment, the gain calculating module 150 may calculate a gain value Gi of adjusting a level of a high frequency using the plurality of gain values G1 to G4.

Thus, a frequency domain processing module 100 of FIG. 1 may transmit level information, including the gain value Gi calculated based on information about the first plurality of frequency bands 320 of the input signal and the reference frequency Fi' of the second plurality of frequency bands 330, to a time domain processing module 200 of FIG. 1.

Figure 4:
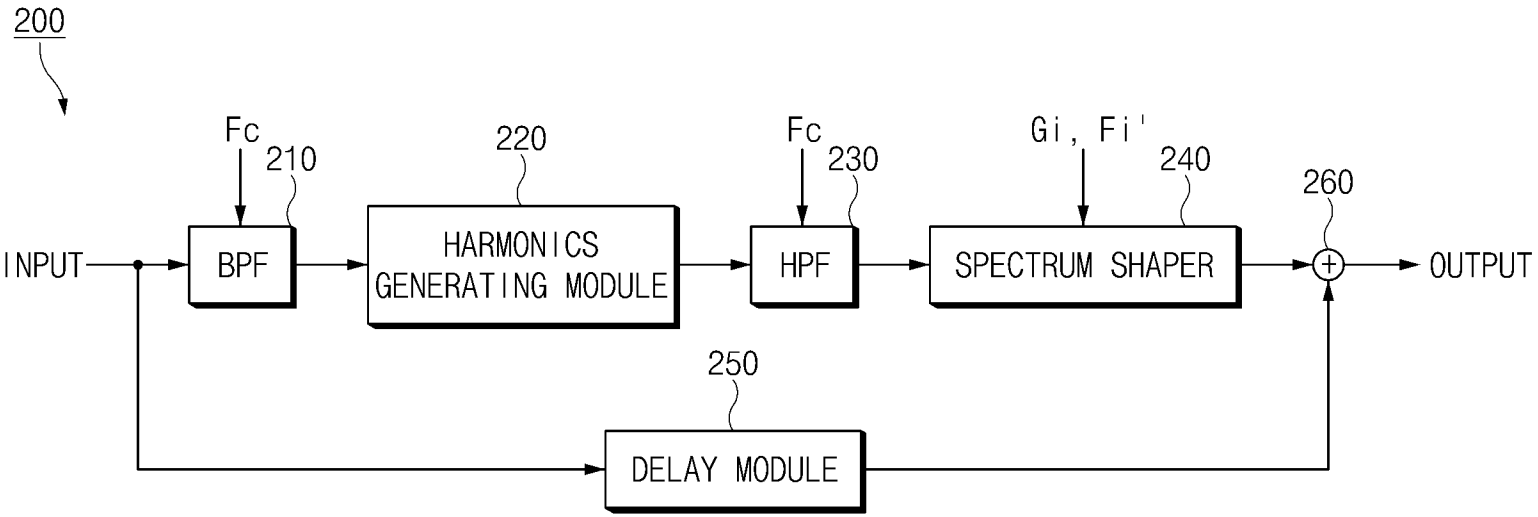
FIG. 4 is a block diagram illustrating an example configuration of a time domain processing module according to an example embodiment of the present disclosure.

FIG. 4 is a block diagram illustrating an example configuration of a time domain processing module according to an example embodiment of the present disclosure.

Referring to FIG. 4, a time domain processing module 200 may include a band pass filter (BPF) module (e.g., including a band pass filter) 210, a harmonics generating module (e.g., including processing circuitry and/or program elements) 220, a high pass filter (HPF) module (e.g., including a high pass filter) 230, a spectrum shaper (e.g., including processing circuitry and/or program elements) 240, a delay module (e.g., including processing circuitry and/or program elements) 250, and an adding module (e.g., including processing circuitry and/or program elements) 260.

The BPF module 210 may pass a specified frequency band of an input signal. The BPF module 210 may receive a cut-off frequency Fc from a frequency domain processing module 100 of FIG. 1 and may set a pass band based on the cut-off frequency Fc. The BPF module 210 may set the pass band to pass only a signal except for a low frequency band of the input signal. The low frequency band may be a region where it is difficult to recover a high frequency band of a noise signal or the input signal. The BPF module 210 may set a frequency band higher than the cut-off frequency Fc to a frequency band higher than the pass band. A frequency band higher than the cut-off frequency Fc of the input signal before recovery may include a noise.

According to an embodiment, the BPF module 210 may pass an input signal of a frequency band between a specified frequency and the cut-off frequency Fc. For example, the specified frequency may be a frequency Fc/2 corresponding to ½ of the cut-off frequency Fc. Thus, the pass band of the BPF module 210 may be a frequency band between the frequency Fc/2 corresponding to ½ of the cut-off frequency Fc and the cut-off frequency Fc.

The harmonics generating module 220 may generate harmonics of the input signal passing through the BPF module 210. The generated harmonics may include a signal of the cut-off frequency Fc or more (or a signal having a frequency greater than or equal to the cut-off frequency Fc). Thus, the harmonics generating module 220 may generate the signal of the cut-off frequency Fc or more of the input signal.

According to an embodiment, the harmonics generating module 220 may amplify the generated harmonics by a specified gain value. Since the harmonics are an element for determining timbre, the harmonics generating module 220 may specify a gain value depending on a characteristic of the input signal and may amplify the harmonics.

Figure 5:
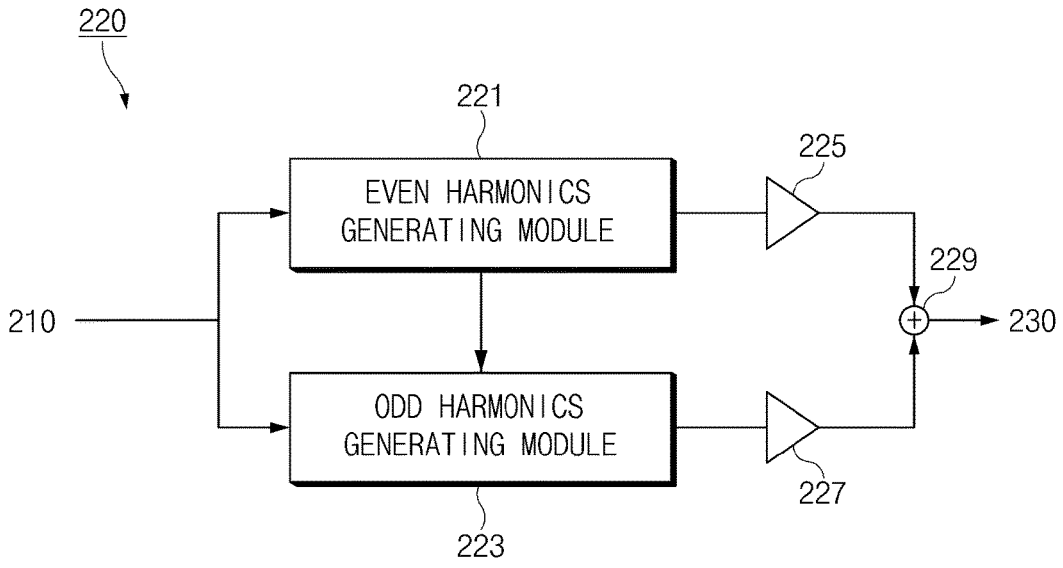
FIG. 5 is a block diagram illustrating an example configuration of a harmonics generating module according to an example embodiment of the present disclosure.

FIG. 5 is a block diagram illustrating an example configuration of a harmonics generating module according to an example embodiment of the present disclosure.

Referring to FIG. 5, a harmonics generating module 220 may include an even harmonics generating module (e.g., including processing circuitry and/or program elements) 221, an odd harmonics generating module (e.g., including processing circuitry and/or program elements) 223, a first amplification module (e.g., including amplifier circuitry) 225, a second amplification module (e.g., including amplifier circuitry) 227, and an adding module (e.g., including processing circuitry and/or program elements) 229. According to an embodiment, the harmonics generating module 220 may be implemented with a non-linear device (or function) which may generate harmonics.

The even harmonics generating module 221 may receive an input signal and may generate an even harmonics (or first harmonics) component of the input signal. For example, the even harmonics generating module 221 may generate the even harmonics using Equation 1 below.

$$x_even=abs(x_bpf) \quad \text{[Equation 1]}$$

Herein, x_even may indicate the even harmonics, and x_bpf may indicate an input signal passing through a BPF module 210 of FIG. 4. The even harmonics may be calculated by an absolute value of the input signal passing through the BPF module 210.

The odd harmonics generating module 223 may receive the input signal and may generate an odd harmonics (or second harmonics) component. For example, the odd harmonics generating module 223 may generate the odd harmonics using Equation 2 below.

$$x_odd=x^3 \approx (x_even*x_bpf) \quad \text{[Equation 2]}$$

Herein, x_odd may indicate the odd harmonics, x may indicate the input signal, x_even may indicate the even harmonics, and x_bpf may indicate an input signal passing through the BPF module 210. For example, the odd harmonics may be calculated by the cube of the input signal. For another example, the odd harmonics may be calculated by multiplying the even harmonics by the input signal passing through the BPF module 210. Since the square of the input signal is similar to an absolute value of the input signal passing through the BPF module 210, the odd harmonics generating module 223 may multiply the even harmonics by the input signal passing through the BPF module 210 to calculate a value similar to the cube of the input signal. If using the event harmonics when obtaining the odd harmonics, since the number of multiplication operations is smaller than if using the input signal, the odd harmonics generating module 223 may quickly generate odd harmonics. Thus, the odd harmonics generating module 223 may receive the even harmonics from the even harmonics generating module 225 and may generate odd harmonics with reference to the received even harmonics.

Figure 6A:
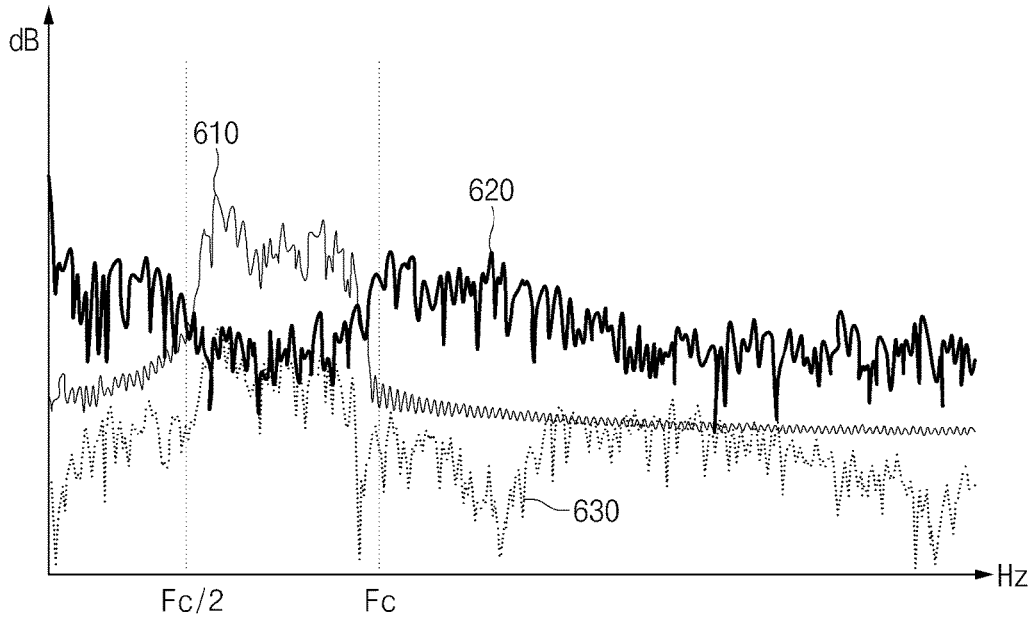
FIG. 6A is a graph illustrating a signal processed by a harmonics generating module according to an example embodiment of the present disclosure.

FIG. 6A is a graph illustrating a signal processed by a harmonics generating module according to an example embodiment of the present disclosure.

Referring to FIG. 6A, an input signal 610 received in a harmonics generating module 220 of FIG. 5 may be generated as even harmonics 620 and odd harmonics 630 through an even harmonics generating module 221 and an odd harmonics generating module 223 of FIG. 5, respectively.

A first amplification module 225 of FIG. 5 may receive the event harmonics from the even harmonics generating module 221 and may amplify the even harmonics by a first gain value Ge. The second amplification module 227 may receive the odd harmonics from the odd harmonics generating module 223 and may amplify the odd harmonics by a second gain value Go.

According to an embodiment, the first amplification module 225 and the second amplification module 227 may amplify the even harmonics and the odd harmonics by the different gain values Ge and Go, respectively. Since characteristics of the even harmonics and the odd harmonics are different from each other, a ratio between the even harmonics and the odd harmonics configuring an audio signal may vary according to the audio signal. Thus, the harmonics generating module 220 may amplify the even harmonics and the odd harmonics by the first gain value Ge and the second gain value Go which are different from each other.

According to an embodiment, the harmonics generating module 220 may change the first gain value Ge and the second gain value Go depending on a characteristic of the input signal 610. The first gain value Ge and the second gain value Go may be changed according to, for example, Equation 3 below.

[Equation 3]

$$\begin{cases} G_e = 1 - \frac{\alpha}{1+\alpha} & 0 < \alpha < 1 \\ G_o = 1 - \alpha & 0 < \alpha < 1 \\ G_e = G_o = 0.5 & \alpha = 1 \\ G_e = G_o = 0.0 & \alpha = 0 \end{cases}$$

Herein, α may be an eigen-value according to a characteristic of an input signal and may be, for example, $$\alpha = \sqrt{\frac{1}{n}\sum_{i=1}^{n} x_i^2}$$

(where n is the number of samples in one frame and where x is a sample value).

An adding module 229 of FIG. 5 may add the amplified even harmonics to the amplified odd harmonics. The adding module 229 may add the even harmonics to the odd harmonics, the even harmonics and the odd harmonics being amplified according to a characteristic of the input audio, to generate harmonics of a cut-off frequency Fc or more.

An HPF module 230 of FIG. 4 may pass a specified frequency band of the harmonics generated by the harmonics generating module 220. The HPF module 230 may receive a cut-off frequency Fc from a frequency domain processing module 100 of FIG. 1 and may set a pass band based on the cut-off frequency Fc. The HPF module 230 may set a frequency band lower than a cut-off frequency Fc of the harmonics to a frequency band lower than the pass band.

According to an embodiment, the HPF module 230 may pass an input signal of a frequency band between the cut-off frequency Fc and a specified frequency. For example, the specified frequency may be a frequency Fs/2 corresponding to ½ of a sampling frequency Fs.

A spectrum shaper 240 of FIG. 4 may adjust a level of the harmonics passing through the HPF module 230, based on level information for adjusting a level of the input signal. For example, the spectrum shaper 240 may receive a gain value Gi of each of a second plurality of frequency bands 330 of FIG. 2 and a second reference frequency Fi' of the second plurality of frequency bands 330 and may process the harmonics passing through the HPF module 230.

According to an embodiment, the spectrum shaper 240 may include a shelving filter. For example, the spectrum shaper 240 may include a plurality of shelving filters respectively corresponding to the second plurality of frequency bands. The shelving filter may be a filter which may increase or decrease a level of a signal. The plurality of shelving filters may increase or decrease a level of harmonics corresponding to each of the second plurality of frequency bands 330.

According to an embodiment, the spectrum shaper 240 may verify the second plurality of frequency bands 330 using the second reference frequency Fi'. The spectrum shaper 240 may divide a frequency band higher than a cut-off frequency Fc of the harmonics passing through the HPF module 230 into the second plurality of verified frequency bands 330. The spectrum shaper 240 may process harmonics corresponding to each of the second plurality of frequency bands 330 by using the second reference frequency Fi' as a cut-off frequency of each of the plurality of shelving filters.

According to an embodiment, the spectrum shaper 240 may adjust a level of each of the second plurality of frequency bands 330 of the harmonics by using a gain value Gi calculated by the frequency domain processing module 100 as a gain value of each of the plurality of shelving filters. The spectrum shaper 240 may use the gain value Gi corresponding to the second reference frequency Fi' (or the second plurality of frequency bands 330) as a gain value of each of the plurality of shelving filters. The gain value Gi corresponding to the second reference frequency Fi' may be a gain value calculated as a difference between adjacent average level values relative to a first reference frequency Fi corresponding to the second reference frequency Fi' of the second plurality of frequency bands 330.

Thus, the spectrum shaper 240 may adjust a level value of harmonics corresponding to each of the second plurality of frequency bands 330 using the second reference frequency Fi' of the second plurality of frequency bands 330 and the gain value Gi.

Figure 6B:
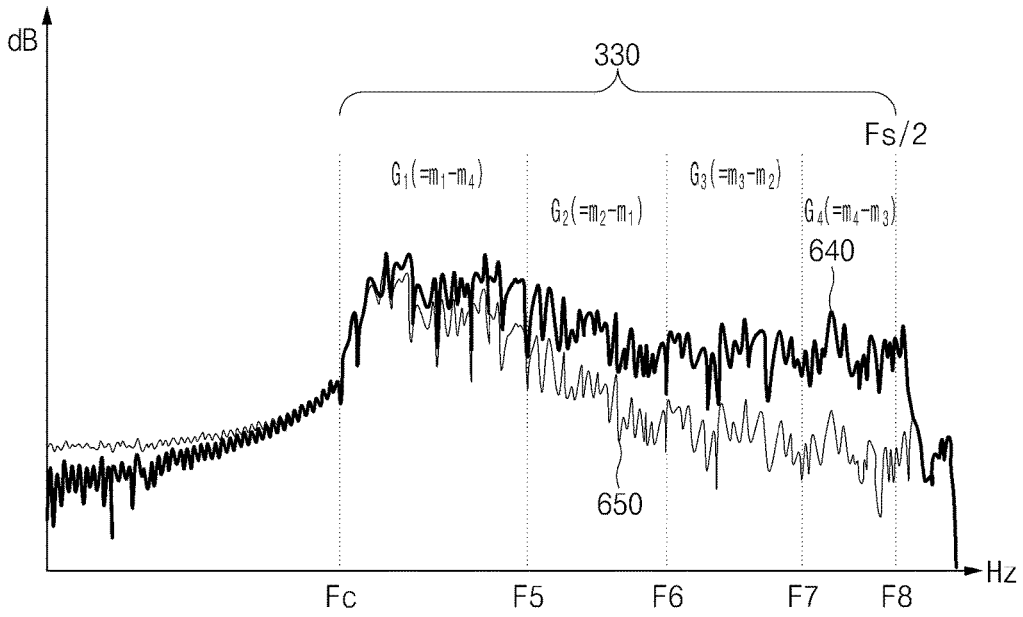
FIG. 6B is a graph illustrating a signal processed by a spectrum shaper according to an example embodiment of the present disclosure.

FIG. 6B is a graph illustrating a signal processed by a spectrum shaper according to an example embodiment of the present disclosure.

Referring to FIG. 6B, a spectrum shaper 240 of FIG. 4 may adjust a height of a harmonics level corresponding to each of a second plurality of frequency bands 330 by using a gain value Gi corresponding to a second reference frequency Fi' of the second plurality of frequency bands 330 as a gain value of each of a plurality of shelving filters. The plurality of shelving filters may include a first shelving filter SF1, a second shelving filter SF2, a third shelving filter SF3, and a fourth shelving filter SF4 respectively corresponding to the second plurality of frequency bands. For example, when a fifth frequency F5 is a cut-off frequency of the first shelving filter SF1, a gain value of the first shelving filter SF1 may be a gain value G1 which is a difference value between average level values of a signal relative to a first frequency F1 of FIG. 3B. For another example, when a sixth frequency F6 is a cut-off frequency of the second shelving filter SF2, a gain value of the second shelving filter SF2 may be a gain value G2 which is a difference value between average level values of a signal relative to a second frequency F2 of FIG. 3B. For another example, when a seventh frequency F7 is a cut-off frequency of the third shelving filter SF3, a gain value of the third shelving filter SF3 may be a gain value G3 which is a difference value between average level values of a signal relative to a third frequency F3 of FIG. 3B. For another example, when a eighth frequency F8 is a cut-off frequency of the fourth shelving filter SF4, a gain value of the fourth shelving filter SF4 may be a gain value G4 which is a difference value between average level values of a signal relative to a fourth frequency F4 of FIG. 3B.

Thus, the spectrum shaper 240 may filter harmonics 640 passing through an HPF module 230 of FIG. 4, through the first shelving filter SF1, the second shelving filter SF2, the third shelving filter SF3, and the fourth shelving filter SF4 to generate a signal 650 of a cut-off frequency Fc or more (or a signal having a frequency greater than or equal to the cut-off frequency Fc) of a recovery signal.

A delay module 250 of FIG. 4 may delay an input signal input to an adding module 260 of FIG. 4. The delay module 250 may delay the input signal by a time when a frequency domain processing module 100 and a time domain processing module 200 of FIG. 1 process the input signal and generate the signal 650 of the cut-off frequency Fc or more of the recovery signal.

The adding module 260 may add a signal configured with harmonics passing through the spectrum shaper 240 to an input signal passing through the delay module 250. Thus, the adding module 260 may generate a recovery signal of the input signal.

Figure 6C:
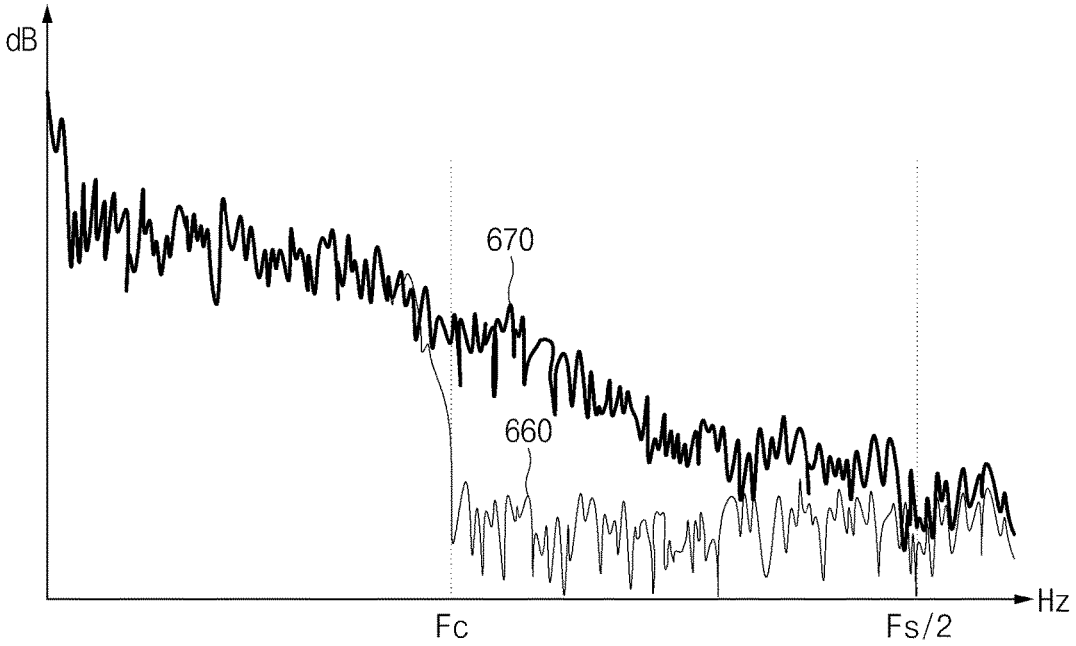
FIG. 6C is a graph illustrating a signal recovered by a signaling device according to an example embodiment of the present disclosure.

FIG. 6C is a graph illustrating a signal recovered by a signaling device according to an example embodiment of the present disclosure.

Referring to FIG. 6C, an adding module 260 of FIG. 4 may add a signal 660 configured with harmonics passing through a spectrum shaper 240 of FIG. 4 to an input signal to generate a recovery signal 670.

According to various embodiments of the present disclosure described with reference to FIGS. 1 to 6C, if recovering a frequency band higher than a cut-off frequency Fc of an input signal, the signaling device 1000 may reduce complexity which may be generated when performing a procedure of the other domain together in one domain and may quickly recover the input signal by generating the cut-off frequency Fc and frequency band information for recovering a frequency band higher than the cut-off frequency Fc at the frequency domain processing module 100 and recovering the frequency band higher than the cut-off frequency Fc of the input signal at the time domain processing module 200 using the cut-off frequency Fc and the frequency band information.

The time domain processing module 200 may separately generate even harmonics and odd harmonics of the input signal and may amplify the even harmonics and the odd harmonics depending on a characteristic of the input signal. Further, the time domain processing module 200 may recover an input signal to be similar to audio data before compression without a distortion of a signal by setting a gain value of a spectrum shaper 240 of FIG. 4 based on the frequency band information and processing harmonics generated by the spectrum shaper 240.

Figure 7:
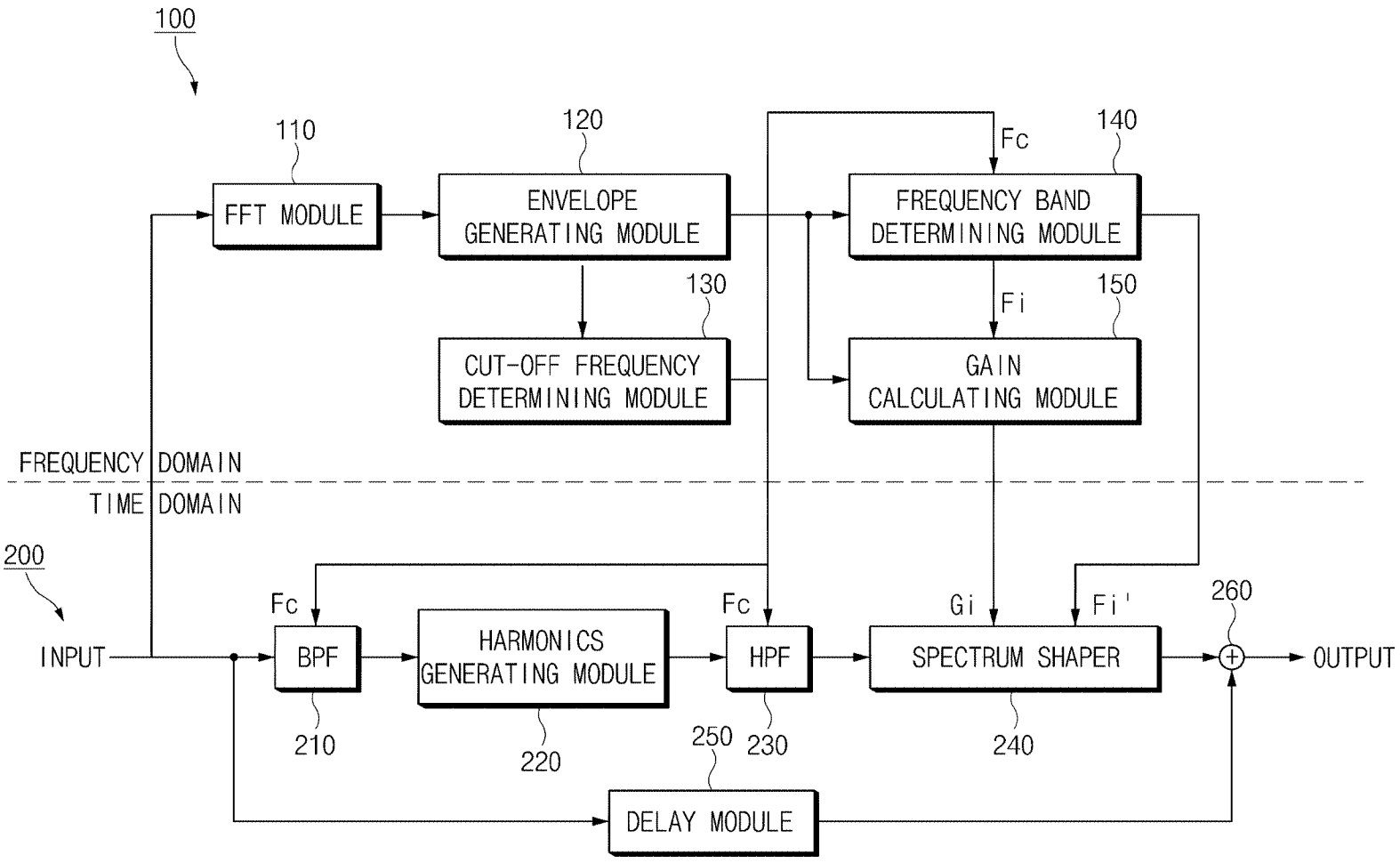
FIG. 7 is a block diagram illustrating an example configuration of a frequency domain processing module and a time domain processing module of a signaling device according to an example embodiment of the present disclosure.

FIG. 7 is a block diagram illustrating an example configuration of a frequency domain processing module and a time domain processing module of a signaling device according to an example embodiment of the present disclosure.

Referring to FIG. 7, a frequency domain processing module 100 of a signaling device 1000 may transmit a cut-off frequency Fc, a gain value Gi, a first reference frequency Fi, and a second reference frequency Fi' to a time domain processing module 200.

Figure 8:
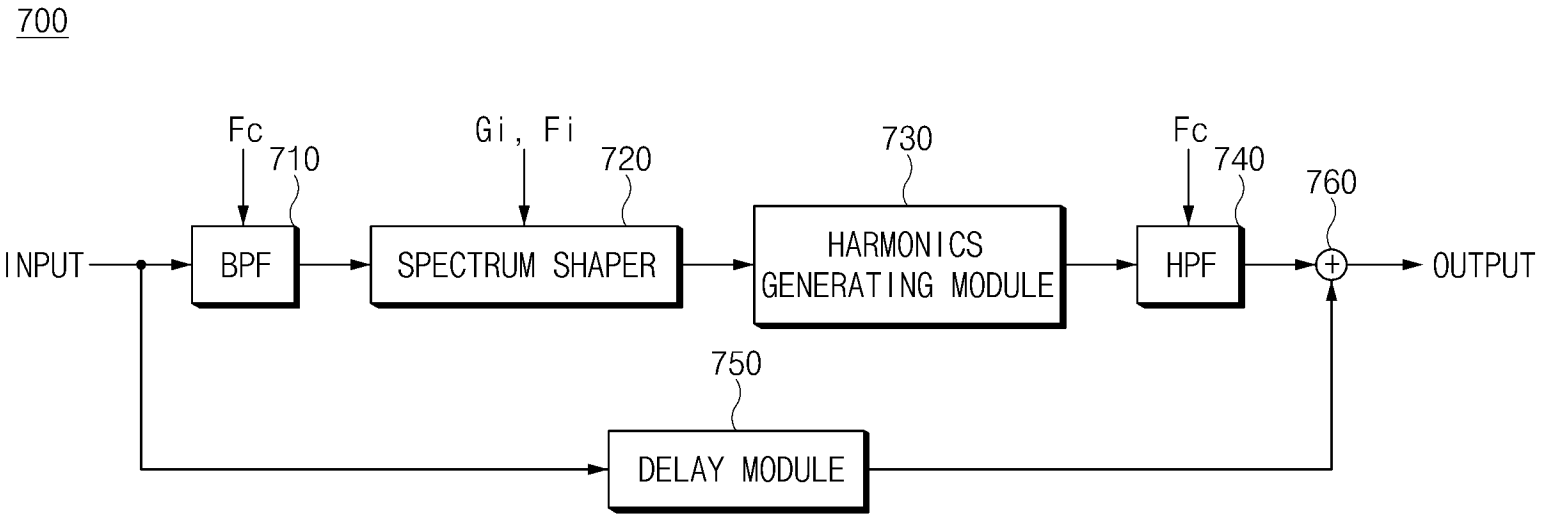
FIG. 8 is a block diagram illustrating an example configuration of a time domain processing module according to an example embodiment of the present disclosure.

FIG. 8 is a block diagram illustrating an example configuration of a time domain processing module according to an example embodiment of the present disclosure.

Referring to FIG. 8, a time domain processing module 700 according to another embodiment of the present disclosure may include a BPF module (e.g., including a band pass filter) 710, a spectrum shaper (e.g., including processing circuitry such a shelving filters and/or program elements) 720, a harmonics generating module (e.g., including processing circuitry and/or program elements) 730, an HPF module (e.g., including a high pass filter) 740, a delay module (e.g., including processing circuitry and/or program elements) 750, and an adding module (e.g., including processing circuitry and/or program elements) 760. The time domain processing module 700 may receive a cut-off frequency Fc, a reference frequency Fi of a first plurality of frequency bands 320, and a gain value Gi of a shelving filter from a frequency domain processing module 100 of FIG. 1. For example, the frequency domain processing module 100 may fail to perform an operation of transmitting a reference frequency Fi' of a second plurality of frequency bands 320 and generating the reference frequency Fi'.

The BPF module 710 may be similar to a BPF module 210 of a time domain processing module 200 of FIG. 4. The BPF module 710 may pass a specified frequency band of an input signal. The specified frequency band may be a frequency band between a frequency Fc/2 corresponding to ½ of a cut-off frequency Fc and the cut-off frequency Fc.

The spectrum shaper 720 may adjust a level of an input signal passing through the BPF module 710 based on level information for adjusting a level of the input signal. For example, the spectrum shaper 720 may receive information about the first plurality of frequency bands 320 and the reference frequency Fi of the first plurality of frequency bands 320 from the frequency domain processing module 100 and may process the input signal passing through the BPF module 710. A frequency band determining module 140 of the frequency domain processing module 100 may determine, for example, the first plurality of frequency bands 320. A gain calculating module 150 of FIG. 2 may generate level information for adjusting a level of the input signal based on information about the first plurality of divided frequency bands 320.

According to an embodiment, the spectrum shaper 720 may include a shelving filter. The spectrum shaper 720 may include a plurality of shelving filters respectively corresponding to the first plurality of frequency bands 320. The plurality of shelving filters may increase or decrease a level value of harmonics corresponding to each of the first plurality of frequency bands 320.

According to an embodiment, the spectrum shaper 720 may verify the first plurality of frequency bands 320 using the first reference frequency Fi. The spectrum shaper 720 may divide a frequency band lower than a cut-off frequency Fc of an input signal passing through the BPF module 710 into the first plurality of verified frequency bands 320. The spectrum shaper 720 may process an input signal of the first plurality of frequency bands 320 by using the first reference frequency Fi as a cut-off frequency of each of the plurality of shelving filters.

According to an embodiment, the spectrum shaper 720 may adjust a level of each of the first plurality of frequency bands 320 of the input signal by using a gain value Gi calculated by the frequency domain processing module 100 as a gain value of each of the plurality of shelving filters. The spectrum shaper 720 may use a gain value Gi corresponding to the first reference frequency Fi (or the first plurality of frequency bands 310) as a gain value of each of the plurality of shelving filters. The gain value Gi corresponding to the first reference frequency Fi may be a gain value calculated as a difference between adjacent average level values relative to the first reference frequency Fi of the first plurality of frequency bands 310.

Thus, the spectrum shaper 720 may adjust a level of an input signal of the first plurality of frequency bands 320 using the first reference frequency Fi of the first plurality of frequency bands 320 and the gain value Gi.

The harmonics generating module 730 may be similar to a harmonics generating module 220 of the time domain processing module 200. The harmonics generating module 730 may generate harmonics of an input signal passing through the spectrum shaper 720. For example, the harmonics generating module 730 may separately generate even harmonics and odd harmonics of an input signal. Thus, the harmonics generating module 730 may generate a signal of a cut-off frequency Fc or more (or a signal having a frequency greater than or equal to the cut-off frequency Fc) of the input signal.

According to an embodiment, the harmonics generating module 730 may amplify the generated harmonics by a specified gain value depending on a characteristic of the input signal. For example, the harmonics generating module 730 may amplify the even harmonics and the odd harmonics by different gain values depending on a characteristic of the input signal.

The HPF module 740 may be similar to an HPF module 230 of the time domain processing module 200. The HPF module 740 may pass a specified frequency band of the harmonics generated by the harmonics generating module 730. The specified frequency band may be a frequency band between a cut-off frequency Fc and a frequency Fs/2 corresponding to ½ of a sampling frequency Fs.

The delay module 750 may be similar to a delay module 250 of the time domain processing module 200. The delay module 750 may delay an input signal input to the adding module 760 by a time when a signal 650 of a cut-off frequency Fc or more of a recovery signal is generated.

The adding module 760 may be similar to an adding module 260 of the time domain processing module 200. The adding module 760 may add a signal configured with the harmonics passing through the HPF module 740 to an input signal passing through the delay module 750. Thus, the adding module 760 may generate a recovery signal of the input signal.

According to various embodiments of the present disclosure described with reference to FIG. 8, the signaling device 1000 may fail to generate information about a frequency band higher than a cut-off frequency Fc at the frequency domain processing module 100 by first processing the input signal using the spectrum shaper 720 and generating the harmonics using the input signal processed by the harmonics generating module 730.

Figure 9:
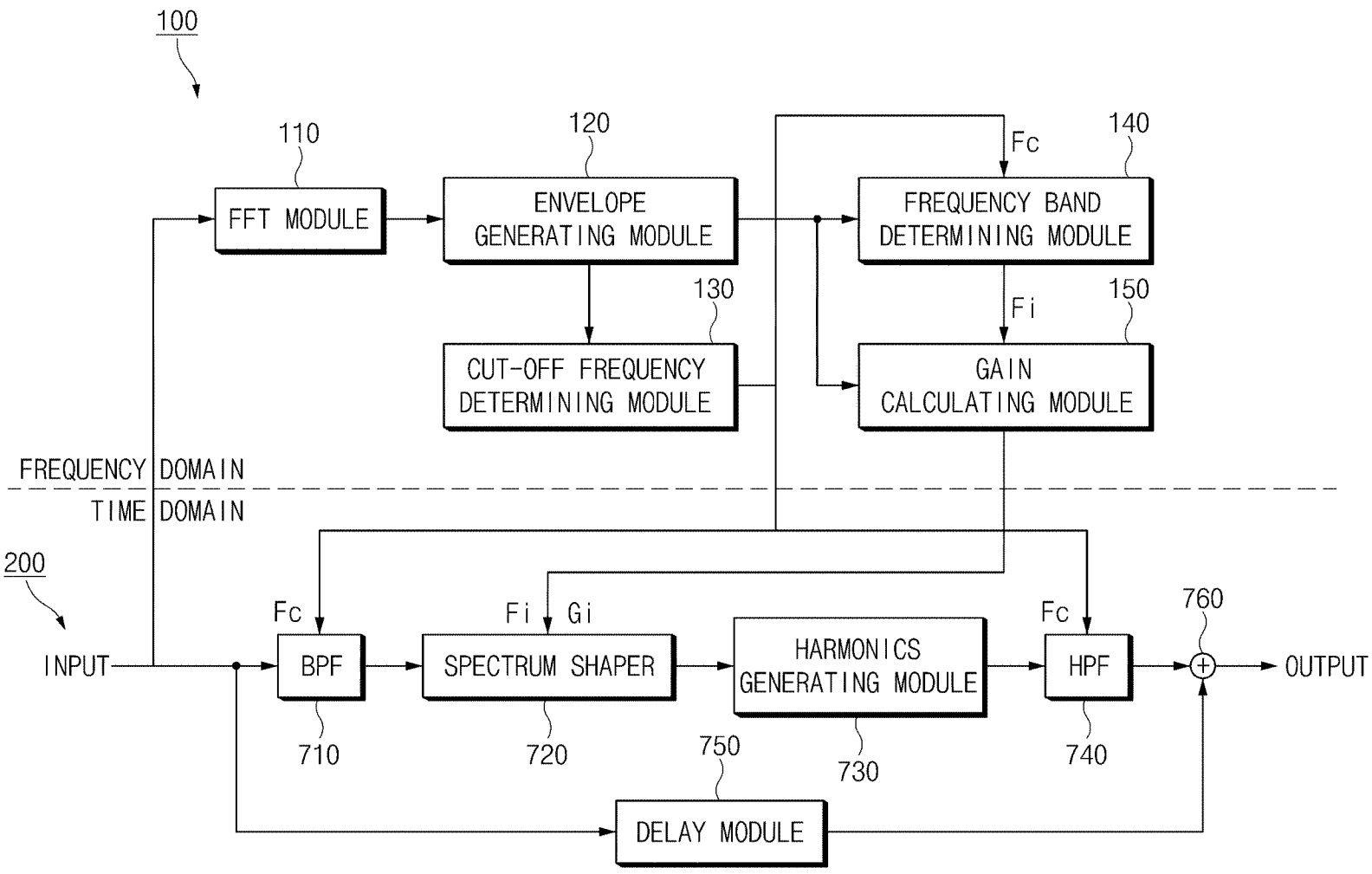
FIG. 9 is a block diagram illustrating an example configuration of a frequency domain processing module and a time domain processing module of a signaling device according to an example embodiment of the present disclosure.

FIG. 9 is a block diagram illustrating an example configuration of a frequency domain processing module and a time domain processing module of a signaling device according to an example embodiment of the present disclosure.

Referring to FIG. 9, a frequency domain processing module 100 of a signaling device 1000 of FIG. 1 may transmit a cut-off frequency Fc, a gain value Gi, and a reference frequency Fi to a time domain processing module 700.

Figure 10:
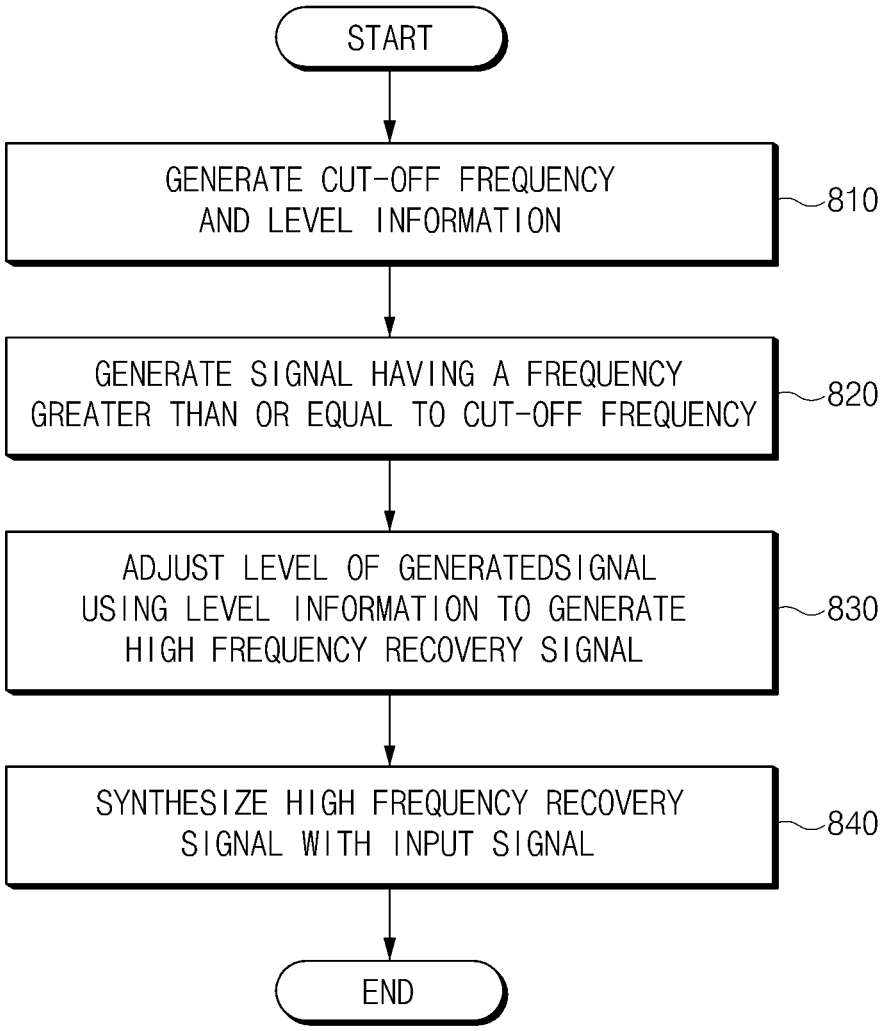
FIG. 10 is a flowchart illustrating an example method of controlling a signaling device according to an example embodiment of the present disclosure.

FIG. 10 is a flowchart illustrating example method of controlling a signaling device according to an example embodiment of the present disclosure.

The flowchart illustrated in FIG. 10 may include operations processed by a signaling device 1000 of FIG. 1. Thus, although there are contents omitted below, contents described about the signaling device 1000 with reference to FIGS. 1 to 6C may be applied to the flowchart of FIG. 10.

According to an embodiment, in operation 810, the signaling device 1000 may generate a cut-off frequency Fc of an input signal and level information for adjusting a level of a high frequency recovery signal in a frequency domain. For example, a frequency domain processing module 100 of the signaling device 1000 may generate an envelope of the input signal and may verify a frequency band with the highest level difference between a peak and a valley of the envelope, thus determining a frequency included in the frequency band as the cut-off frequency Fc. For example, the frequency domain processing module 100 of the signaling device 1000 may calculate first and second reference frequencies Fi and Fi' which may divide upper and lower frequency bands of the cut-off frequency Fc and a gain value Gi of a shelving filter of a time domain processing module 200 or 700 based on the cut-off frequency Fc.

According to an embodiment, in operation 820, the signaling device 1000 may generate a signal of the cut-off frequency Fc or more (or a signal having a frequency greater than or equal to the cut-off frequency Fc) using part of a signal of a frequency lower than the cut-off frequency Fc in the input signal in a time domain. For example, the time domain processing module 200 of the signaling device 1000 may generate harmonics of the input signal using a signal of a frequency lower than the cut-off frequency Fc of the input signal. The time domain processing module 200 of the signaling device 1000 may generate a signal of the cut-off frequency Fc or more using the generated harmonics.

According to an embodiment, in operation 830, the signaling device 1000 may adjust a level of the generated signal using the level information in the time domain to generate a high frequency recovery signal.

According to an embodiment, in operation 840, the signaling device 1000 may synthesize the high frequency recovery signal with the input signal in the time domain. For example, the time domain processing module 200 of the signaling device 1000 may delay the input signal and may synthesize the delayed input signal with the high frequency recovery signal.

The term "module" used in this disclosure may refer, for example, to a unit including one or more combinations of hardware, software and firmware. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, and without limitation, the "module" may include at least one of a dedicated processor, a CPU, an application-specific IC (ASIC) chip, a field-programmable gate array (FPGA), and a programmable-logic device for performing some operations, which are known or will be developed.

At least a part of an apparatus (e.g., modules or functions thereof) or a method (e.g., operations) according to various embodiments may be, for example, implemented by instructions stored in computer-readable storage media in the form of a program module. The instruction, when executed by a processor, may cause the one or more processors to perform a function corresponding to the instruction. The computer-readable storage media, for example, may be the memory.

A computer-readable recording medium may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk)), and hardware devices (e.g., a read only memory (ROM), a random access memory (RAM), or a flash memory). Also, a program instruction may include not only a mechanical code such as things generated by a compiler but also a high-level language code executable on a computer using an interpreter. The above hardware unit may be configured to operate via one or more software modules for performing an operation of various embodiments of the present disclosure, and vice versa.

A module or a program module or program elements according to various embodiments may include at least one of the above elements, or a part of the above elements may be omitted, or additional other elements may be further included. Operations performed by a module, a program module, or other elements according to various embodiments may be executed sequentially, in parallel, repeatedly, or in a heuristic method. In addition, some operations may be executed in different sequences or may be omitted. Alternatively, other operations may be added.

While the present disclosure has been illustrated and described with reference to various example embodiments thereof, it will be understood by those skilled in the art that various changes in form and details may be made therein without departing from the spirit and scope of the present disclosure as defined by the appended claims and their equivalents.

What is claimed is:

1. A signaling processor, comprising:

a frequency domain processing module comprising processing circuitry configured to generate a cut-off frequency of an input signal and to generate level information for adjusting a level of a high frequency recovery signal; and a time domain processing module comprising processing circuitry configured to receive the cut-off frequency and the level information from the frequency domain processing module, to generate a signal having a frequency greater than or equal to the cut-off frequency using part of a signal having a frequency lower than the cut-off frequency in the input signal, to generate the high frequency recovery signal by adjusting a level of the generated signal using the level information, and to synthesize the high frequency recovery signal with the input signal.

2. The signaling processor of claim 1, wherein the input signal comprises additional information about a format of the input signal, and wherein the frequency domain processing module is configured to:

generate the cut-off frequency in a frequency band corresponding to the additional information.

3. The signaling processor of claim 2, wherein the frequency domain processing module is configured to:

generate the cut-off frequency in a band between a first frequency lower than a frequency corresponding to the additional information and a second frequency corresponding to ½ of a sampling frequency of the input signal.

4. The signaling processor of claim 2, wherein the frequency domain processing module is configured to:

generate one of frequencies included in a frequency band having a greatest level difference between a peak and a valley in the input signal of the frequency band corresponding to the additional information as the cut-off frequency.

5. The signaling processor of claim 1, wherein the time domain processing module is configured to:

generate the signal having a frequency greater than or equal to the cut-off frequency using a signal between a frequency corresponding to ½ of the cut-off frequency and the cut-off frequency in the input signal.

6. The signaling processor of claim 1, wherein the time domain processing module is configured to:

generate harmonics using part of a signal of a frequency lower than the cut-off frequency in the input signal; and generate the signal having a frequency greater than or equal to the cut-off frequency using the generated harmonics.

7. The signaling processor of claim 6, wherein the harmonics comprise first harmonics and second harmonics, wherein the time domain processing module is configured to:

amplify the first harmonics and the second harmonics by different gain values, respectively; and generate the signal having a frequency greater than or equal to the cut-off frequency using the amplified first harmonics and the amplified second harmonics.

8. The signaling processor of claim 1, wherein the frequency domain processing module is configured to:

divide a frequency band lower than the cut-off frequency into a first plurality of frequency bands; and generate the level information of the high frequency recovery signal using a level value of each of the first plurality of frequency bands of the input signal.

9. The signaling processor of claim 8, wherein the frequency domain processing module is configured to:

divide a frequency band between a frequency corresponding to ½ of the cut-off frequency and the cut-off frequency into the first plurality of frequency bands; and generate the cut-off frequency and the level information of the high frequency recovery signal corresponding to each of bands in which a ½ band of a sampling frequency of the input signal is divided into a same number as the number of the first plurality of frequency bands.

10. The signaling processor of claim 8, wherein the level information of the high frequency recovery signal comprises:

a gain value based on a difference between average level values of a frequency band adjacent to each of the first plurality of frequency bands of the input signal.

11. The signaling processor of claim 1, wherein the time domain processing module is configured to:

receive the cut-off frequency and the level information from the frequency domain processing module;

adjust a level of part of a signal having a frequency lower than the cut-off frequency in the input signal using the level information;

generate the high frequency recovery signal using the signal, the level of which is adjusted; and synthesize the high frequency recovery signal with the input signal.

12. A method controlling a signaling processor, the method comprising:

generating a cut-off frequency of an input signal and level information for adjusting a level of a high frequency recovery signal in a frequency domain;

generating a signal having a frequency greater than or equal to the cut-off frequency using part of a signal having a frequency lower than the cut-off frequency in the input signal in a time domain;

generating the high frequency recovery signal by adjusting a level of the generated signal using the level information in the time domain; and synthesizing the high frequency recovery signal with the input signal in the time domain.

13. The method of claim 12, wherein the generating of the cut-off frequency comprises:

generating the cut-off frequency in a frequency band corresponding to additional information about a format of the input signal, the additional information being included in the input signal.

14. The method of claim 13, wherein the generating of the cut-off frequency in the frequency band corresponding to the additional information comprises:

generating the cut-off frequency in a band between a first frequency lower than a frequency corresponding to the additional information and a second frequency corresponding to ½ of a sampling frequency of the input signal.

15. The method of claim 13, wherein the generating of the cut-off frequency in the frequency band corresponding to the additional information comprises:

generating one of frequencies included in a frequency band with a greatest level difference between a peak and a valley in the input signal of the frequency band corresponding to the additional information, as the cut-off frequency.

16. The method of claim 12, wherein the generating of the signal of the cut-off frequency or more comprises:

generating the signal having a frequency greater than or equal to the cut-off frequency using a signal between a frequency corresponding to ½ of the cut-off frequency and the cut-off frequency in the input signal.

17. The method of claim 12, wherein the generating of the signal of the cut-off frequency or more comprises:

generating harmonics using part of a signal having a frequency lower than the cut-off frequency in the input signal; and generating the signal having a frequency greater than or equal to the cut-off frequency using the generated harmonics.

18. The method of claim 17, wherein the harmonics comprise first harmonics and second harmonics, wherein the generating of the signal having a frequency greater than or equal to the cut-off frequency comprises:

amplifying the first harmonics and the second harmonics by different gain values, respectively; and generating the signal having a frequency greater than or equal to the cut-off frequency using the amplified first harmonics and the amplified second harmonics.

19. The method of claim 12, wherein the generating of the level information for adjusting the level of the high frequency recovery signal comprises:

dividing a frequency band lower than the cut-off frequency into a first plurality of frequency bands; and generating the level information of the high frequency recovery signal using a level value of each of the first plurality of frequency bands of the input signal.

20. The method of claim 19, wherein the dividing into the first plurality of frequency bands comprises:

dividing a frequency band between a frequency corresponding to ½ of the cut-off frequency and the cut-off frequency into the first plurality of frequency bands, and wherein the generating of the level information of the high frequency recovery signal comprises:

generating the cut-off frequency and the level information of the high frequency recovery signal corresponding to each of bands in which a ½ band of a sampling frequency of the input signal is divided into a same number as the number of the first plurality of frequency bands.

* * * * *